US008857310B2

(12) United States Patent
Raiser

(10) Patent No.: US 8,857,310 B2
(45) Date of Patent: Oct. 14, 2014

(54) COMPACT BULLET PROOF SHIELD

(76) Inventor: Aaron Raiser, Woodland Hills, CA (US)

( * ) Notice: Subject to any disclaimer, the term of this patent is extended or adjusted under 35 U.S.C. 154(b) by 0 days.

(21) Appl. No.: 13/005,532

(22) Filed: Apr. 4, 2011

(65) Prior Publication Data

US 2011/0239850 A1 Oct. 6, 2011

Related U.S. Application Data

(60) Provisional application No. 61/282,272, filed on Jan. 12, 2010.

(51) Int. Cl.
*F41H 5/08* (2006.01)

(52) U.S. Cl.
CPC ..... *F41H 5/08* (2013.01)
USPC ..... 89/36.07; 89/905; 89/914; 89/926

(58) Field of Classification Search
CPC ..... F41H 5/06; F41H 5/08; F41H 5/12; F41H 5/14
USPC ..... 89/36.05, 36.06, 36.07, 905, 914, 915, 89/916, 926; 2/2.5
See application file for complete search history.

(56) References Cited

U.S. PATENT DOCUMENTS

| | | | | | |
|---|---|---|---|---|---|
| 4,412,495 | A * | 11/1983 | Sankar | 109/49.5 |
| 5,340,189 | A * | 8/1994 | Goodman | 296/152 |
| 5,438,908 | A * | 8/1995 | Madden, Jr. | 89/36.08 |
| 5,756,922 | A * | 5/1998 | Fuller | 89/36.08 |
| 7,302,880 | B1 * | 12/2007 | Elasic | 89/36.07 |

* cited by examiner

*Primary Examiner* — Stephen M Johnson

(57) ABSTRACT

A compact bullet-proof shield capable of providing full-body protection consisting an upper part, the upper part consisting of a bullet-proof viewing area surrounded by a bullet-proof fabric set in a hardening resin, and a lower part consisting of a second bullet proof fabric attached to the lower side of the upper part of the invention, which second bullet proof fabric is folded up, and which fabric can become unfurled when the user of the present invention needs full body protection from a bullet fired from gun which is in front of the user.

12 Claims, 5 Drawing Sheets

COMPACT BULLET PROOF SHIELD

RELATED U.S. APPLICATION DATA

This patent claims the benefit of: Compact Bullet Proof Shield—provisional patent application 61/282,272 filed Jan. 12, 2010.

STATEMENT REGARDING FEDERALLY SPONSORED RESEARCH OR DEVELOPMENT

This application contains no rights made under federally sponsored research and development.

BACKGROUND OF THE INVENTION

The present invention pertains to field of personal safety devices and specifically to a device which can protect the user from bullets fired at them with a gun or rifle.

Currently a law enforcement officer (police officer) relies on a bullet proof vest to protect them from gunfire. A police officer can also use a full-body shield to protect them from gunfire, however, these shields are too bulky, heavy and awkward to use in the day-to-day line of duty. This leaves a police officer's head, neck, arms and legs vulnerable to gunfire.

Common examples where officers are shot an killed in the line of duty due to a lack of full-body gunfire protection are (1) an officer shot during a routine traffic stop (2) an officer shot approaching a house on a domestic violence call (3) an officer shot pursing a bank robber on foot and (4) an officer shot approaching a drug suspect. In each of these instances, had the officer had some means to protect themselves from the gunfire the officer's life might not have been taken.

Related to a police officer's level of protection is public safety. A police officer who is threatened with, or believes they are threatened, by a suspect believed to be having a gun must make split second decisions as to whether to shoot that suspect, if that suspect present a threat to the officer's life or safety. A police officer that has full body protection is not in the same imminent danger as an officer that does not have full body protection, which gives the police officer a added amount of time to make sure that a suspect indeed has a gun or not.

Examples of citizens shot by police where the police wrongly believed the suspect had a gun are (1) a citizen that was shot when pulling a wallet out of their pocket to produce their ID, (2) a citizen holding a garden hose spray nozzle shot by a police officer who mistook it for a gun (3) a party-goer with a toy gun playfully pointing it at a police officer at a costume party and (4) a citizen who was hard of hearing holding a legal carving knife standing 10 feet from the police officers who did not drop the knife when ordered. In each of these instances, had the police officers had full body they would have had a greater amount of time to asses the true level danger because with they would not have felt in imminent danger, and the loss of life of an otherwise non-life-threatening citizen might have been avoided.

BRIEF SUMMARY OF THE INVENTION

The present invention provides a lightweight and easy to carry transparent shield that an officer can carry and hold in front of them to cover their face and neck from gunfire, and contains a deployable bullet proof fabric in a compartment at the bottom part of the transparent shield which can be deployed by the officer pulling a lever or pushing a button, the bullet proof fabric unfurling downward and with such a width as to provide the police officer full body protection from gunfire.

DETAILED DESCRIPTION OF THE INVENTION

Figure 1:
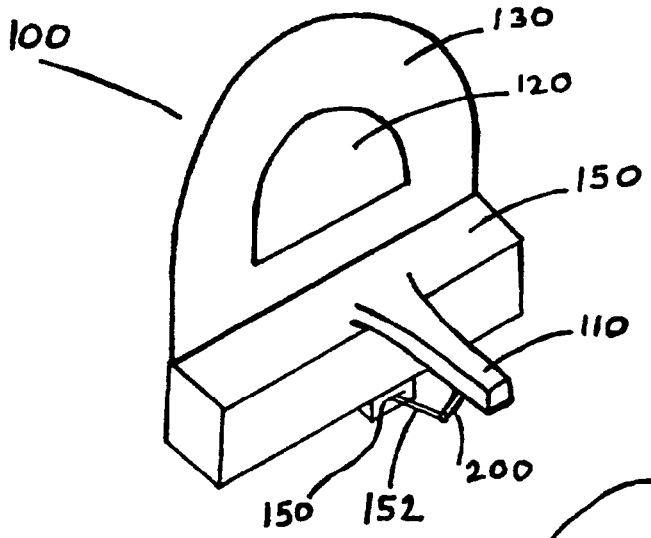
FIG. 1 is a rear view of the present invention with the bullet-proof curtain in the undeployed state.
Figure 2:
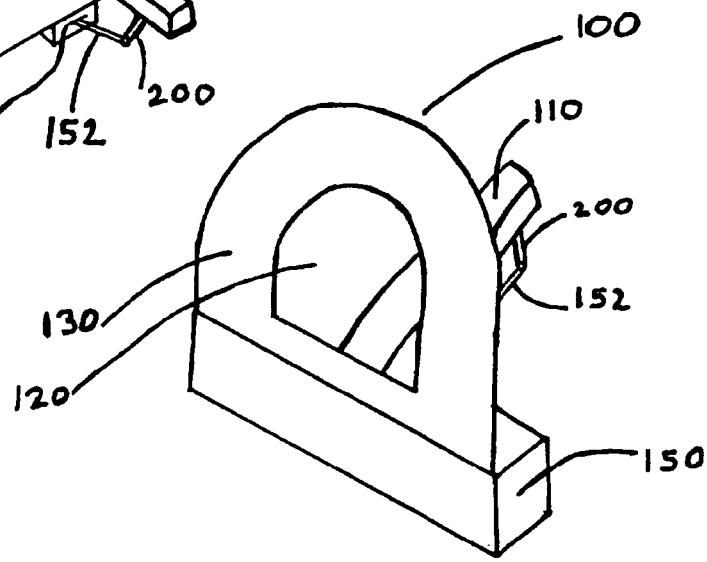
FIG. 2. is a front view of the present invention with the bullet-proof curtain undeployed.

The utility of the present invention can be seen from FIG. 1 through FIG. 7. Referring to FIG. 1, a user of the present invention holds the bullet-proof shield 100 by the handle 110. The bullet-proof shield 100 is made of lightweight materials and can be easily moved, raised and/or lowered by the user.

The bullet-proof shield 100 has an upper half which includes an inner part which is a bullet proof transparent viewing area 120. The transparent viewing area 120 allows the user to see what is in front of them and the user can see a person and whether that person is holding a gun or other deadly object. The transparent viewing area 120 can be made of a polycarbonate material of suitable width and composition to withstand the impact of a bullet fired from a gun. The use of a polycarbonate material is illustrative only and the transparent viewing area 120 can be made of any suitable material what is transparent and allows the user to see in front of them, which material can also withstand the impact of a bullet fired from a gun.

The outer trim part 130 which is a trimming made of a bullet proof material such as Kevlar or Goldflex fabric to name a few. The use of Kevlar of Goldflex is illustrative only and the outer trim part 130 can be made of any material which can withstand the impact of a bullet fired from a gun. The fabric can be set in a resin such as polyester, vinylester, or epoxy so that that fabric becomes hardened. The fabric would contain sufficient layers to withstand the impact of a bullet fired from a gun. The outer trim part 130 immediately abutts the bullet proof transparent viewing area 120. The outer trim part can be secured to the transparent viewing area 120 by a means such with rivets, screws or glue material. The use of a resin is illustrative only and the outer trim part 130 can consist of a bullet proof fabric without a resin, in combination with a frame attached to the bullet proof transparent viewing area 120 such that the bullet proof fabric can be attached to and cover the frame to cover the surface area as the bullet proof fabric using a resin.

It should be understood by one skilled in the art that there is a certain degree of tradeoff in the size of the upper half and thickness of the materials used. For example, a larger viewing area allows the user to see a greater amount of space in front of them. However, a larger viewing area increases the weight of the present invention 100 which decreases its utility as it makes it harder to carry and manuver. A larger width and height of the viewing area also gives the user greater protection, however, it also increases the weight of the present invention 100 which makes it more difficult to use. Likewise, the thickness of the viewing area and number of fabric layers determines the size and velocity of the bullets it is able to stop. The thicker the width and greater the number of layers of the bullet proof fabric increases the bullet-proof rating, yet increases the weight which makes the present invention 100 more difficult to carry and use. These tradeoffs must be taken into consideration when building the present invention in concert with the needs and conditions it shall be used in.

Figure 6:
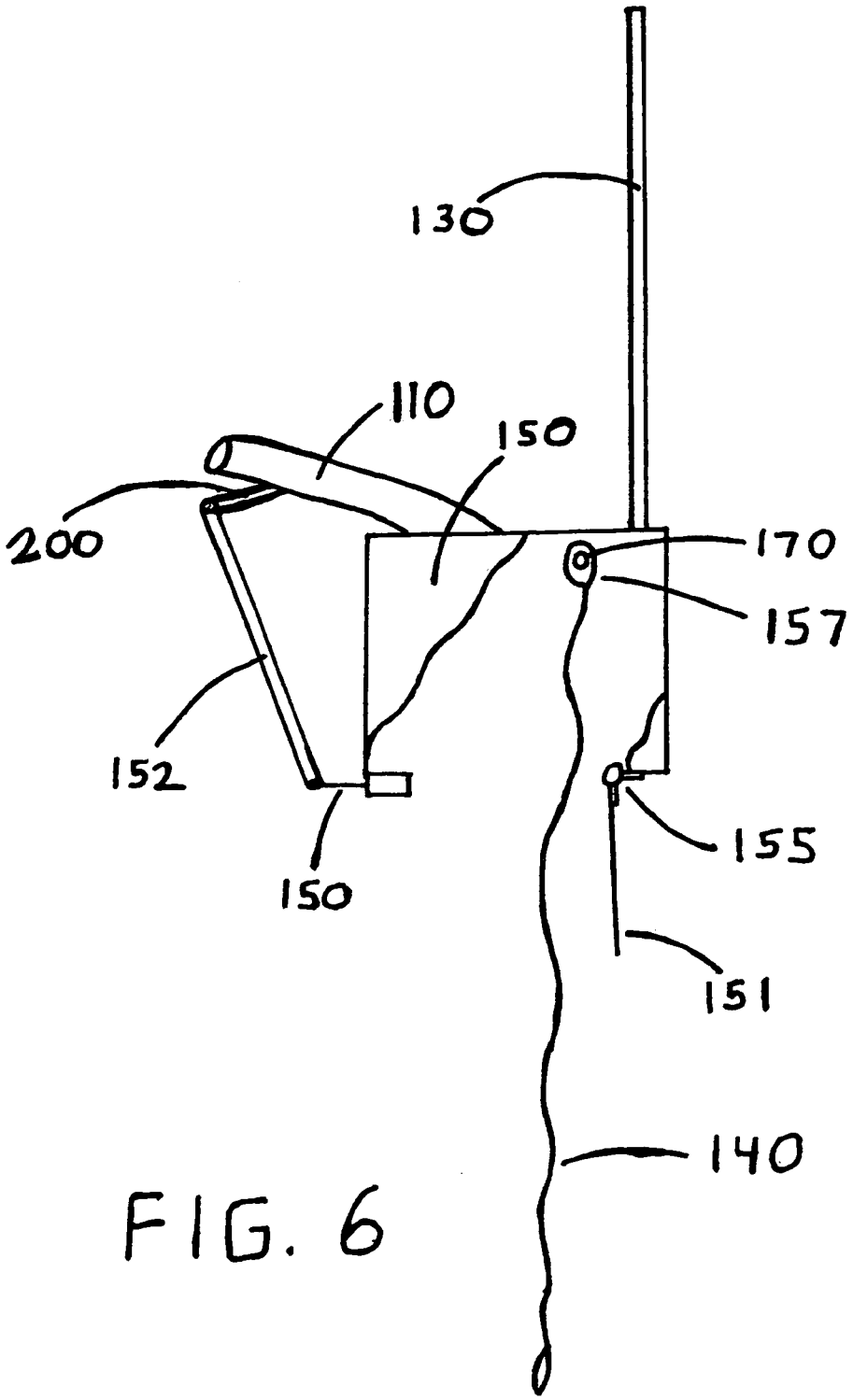
FIG. 6 is a cut away side view of the present invention showing the bullet proof curtain deployed.
Figure 7:
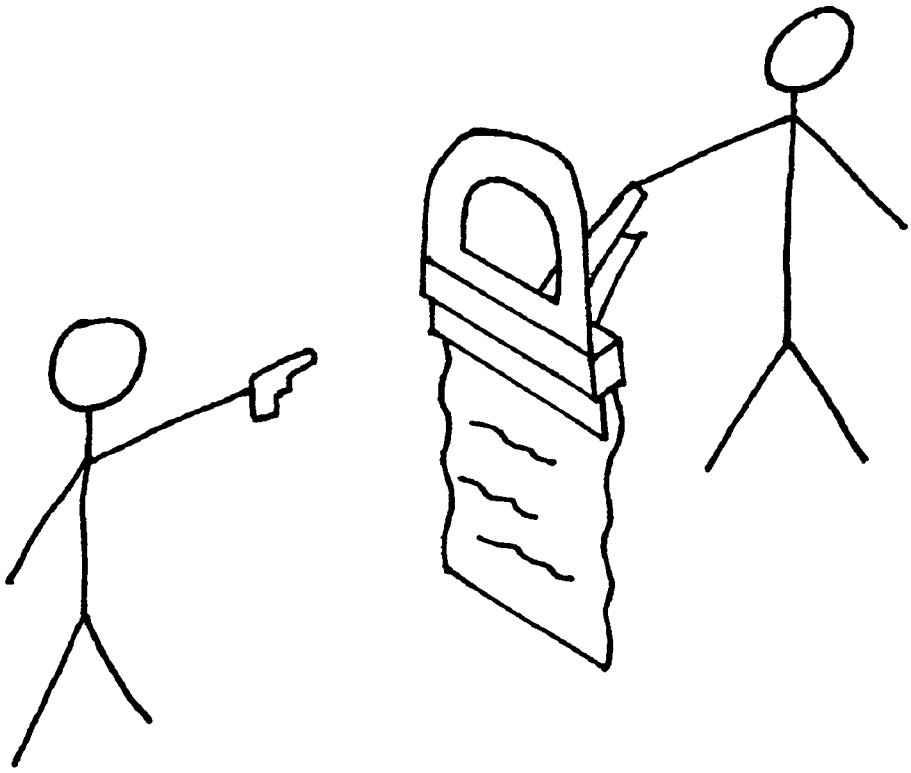
FIG. 7 is a view showing a person using the present invention for protection from another person that has a gun.

The present invention also has a lower part consisting of a bullet proof material 140 such as Kevlar or Goldflex. Referring to FIG. 6, the bullet proof material 140 can be folded up and also put inside a housing 150. The use of Kevlar or Goldflex is illustrative only and the material can be any bullet proof fabric or material that can be folded or compressed in such a way that it fits conveniently underneath the upper half of the present invention. When the bullet proof material 140 consists of a bullet-proof fabric such as Kevlar or Goldflex, the fabric must be of a sufficient number of layers to stop a bullet. The use of a housing 150 is not mandatory and is used for convenience to securely house the bullet proof material 140 when compressed or folded up.

The housing 150 can be made of any suitable material such as thermo-plastic, plastic or a lightweight metal which can house the bullet proof curtain and withstand being dropped and other impacts of law enforcement type work.

Figure 3:
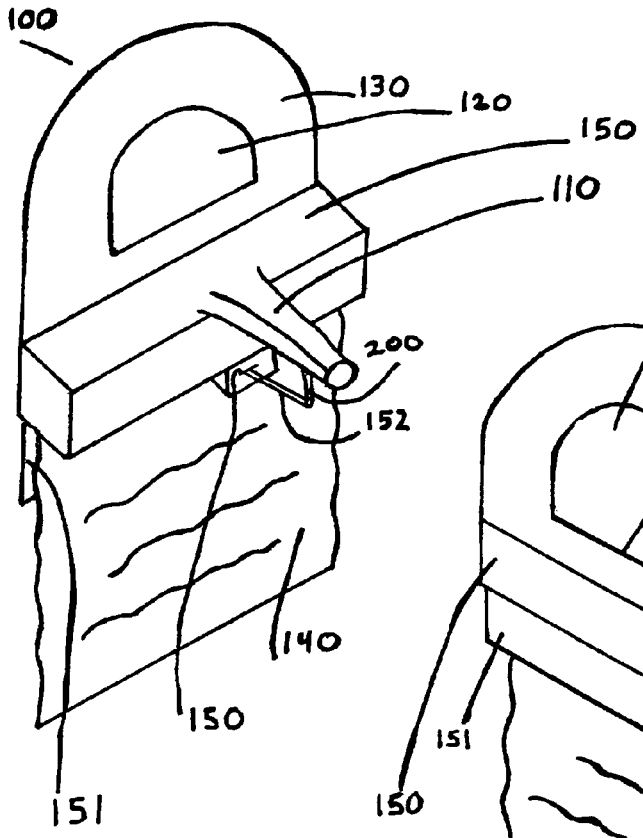
FIG. 3 is a rear view of the present invention with the bullet-proof curtain deployed.
Figure 4:
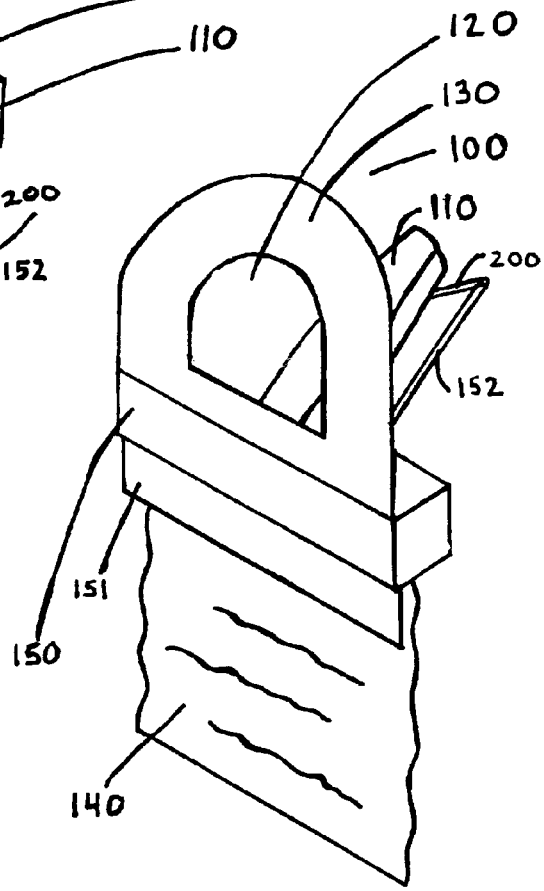
FIG. 4 is a front view of the present invention with the bullet-proof curtain udeployed.
Figure 5:
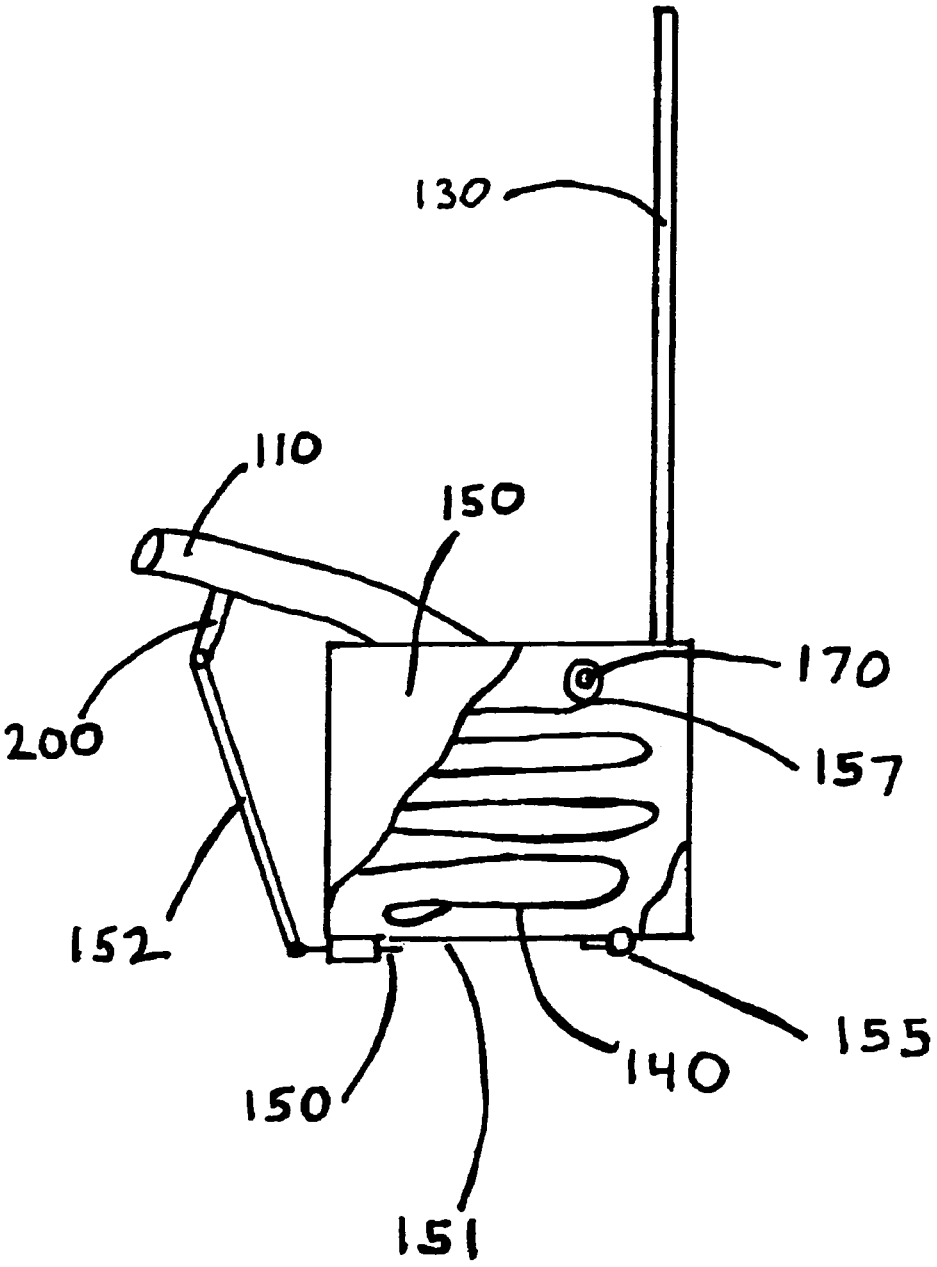
FIG. 5 is a cut away side view of the present invention showing the bullet proof curtain stored inside the curtain housing.

Referring to FIG. 6, the bullet-proof material 140 is securely mounted at the top edge of the material or fabric to the top inside of the housing 150. In this manner the bullet-proof material 140 can be unfurled. Referring to FIG. 5, when the bullet-proof material 140 is compressed or folded inside the housing 150, the bullet-proof material 140 remains inside the housing, being held inside the housing by the lower bottom of the housing which lower bottom part of the housing is a housing compartment door 151 which door can be opened. When the housing compartment door 151 is opened, the bullet-proof material 140 unfurls. The bullet-proof material 140 is attached to the inside of the housing 150 by a mechanism. The mechanism can be a rod 170 which is attached to each side of the housing 150 which passes through a loop 157 created by looping and sewing the bullet-proof material to itself similar to sewing the hem of a dress. FIG. 3 and FIG. 4 show the present invention 100 with the bullet-proof material 140 in the unfurled state. In the unfurled state the present invention provides full-body protection from gunfire.

It should be understood by one skilled in the art that there are certain trade-offs between the size and thickness of the bullet-proof material 140 and the usability of the present invention 100. If the bullet-proof material 140 is of a greater width and height, it provide the user with greater protection, yet it also increases the weight of the present invention which makes it less desirable and more difficult to carry and to use. The thickness of the bullet-proof material 140 also provide greater protection against larger and faster moving bullets, however, this also increased the weight and decreases its usability. Thus the needs of the user and the conditions in which it is used must be taken into consideration when building the present invention 100.

Referring to FIG. 5, the present invention has an actuating device 200 mounted on the handle 110. The actuating device can be a lever or a button which when pulled or pushed causes a mechanism 152 to disengage a latch 153 holding the door 151 shut, causing the door 151 to open, allowing the bullet proof fabric 140 to unfurl towards the ground. The mechanism 152 can be a cable. The door is attached to the body of the housing by one or more hinges 155 which allow the door to swing open when the the latch pin is moved from underneath the door. The actuating devices 200 as shown can be pulled by the user. When the lever 200 pulled as shown, a cable 152 is moved. Referring to FIG. 6, the cable 152 is attached to the pin 150 holding the door 151 shut to move from under the door 151, allowing the door 151 to swing open, and the bullet proof material 140 to unfurl. It should be understood by one skilled in the art that the use of a cable is illustrative, and that the actuating mechanism to open the door 151 can consist of any suitable mechanism to cause the door 151 to open when the lever 200 is pulled. The lever is also illustrative and a button or other suitable means can be used such a that when the user want the door 151 to open to deploy the bullet proof curtain 110 when desired. The actuating mechanism cable 152 can also be routed inside the handle 110.

It should be understood by one skilled in the art that while the main objective of the present invention is to protect from a bullet fired from a gun, it can also protect the user from other types of projectile such as a knife thrown at the user.

The present invention can also have a light that can be mounted in the front such that at night it can be turned on or off by the user by a switch on the handle to conveniently provide better visibility.

The present invention as described allows a user to carry a relatively light weight object which can be held in front of the user to shield the user's head and shoulders from a bullet fired from a gun. When the user needs full body protection from gunfire the user can deploy a bullet proof curtain attached to the present invention which when deployed, provide the user full-body protection from a gun fired in front of the user.

BEST MODE FOR CARRYING OUT THE INVENTION

The present invention can be constructed with a transparent polycarbonate viewing area with a width of 7 inches and a height of 5 inches. The thickness of the transparent polycarbonate viewing area would be approximately 2 inches depending on the exact polycarbonate used and the desired bullet protection needed.

The trim part can be constructed from Kevlar fabric set in an epoxy. The trim would extend 4 inches from edges of the transparent polycarbonate viewing area, giving the entire width of the upper half of the invention a total with of 15 inches and a height 13 inches.

The trim part can be attached to the transparent polycarbonate viewing area with an epoxy, screws or rivets.

Attached to the upper half of the invention is a housing having a width of 18 inches, a height of 5 inches and depth of 5 inches. The housing can be made of a thermoplastic polymer such as polypropylene with a UV absorbing or protecting additive. The housing can be attached to the upper half of the invention by epoxy, rivets or screws. The bottom of the housing has a door panel made of the same material as the housing which is attached to remaining part of the housing by hinges, the hinges being made of a suitable metal or plastic material, the hinges being attached to the housing door panel and housing at the edges furthest from the user in such a way that when the door housing door panel is open it swings away from the user. The housing door panel when closed remains closed by a movable latch pin located under the housing door panel at the edge closest to the user. When the latch pin is moved from away from under the housing door panel in the direction towards the user, the door panel opens.

Attached to the housing at the top side of the housing is a handle which allows the user to hold and move the present invention. Attached to the handle is a lever. The lever can be pulled by the user towards the user. A cable is attached to the lever at one end and the other end of the cable is attached to the latch pin located at the bottom of the housing holding the housing door panel in place. When the lever is pulled by the user towards the user, the tension of the cable pulls the latch pin from underneath the housing door panel allowing the housing panel door to swing open.

A bullet-proof fabric made of Kevlar having a width of 17 inches and a height of 42 inches, and made up of sufficient layers to stop a bullet of a desired size and velocity, is attached to the top, inside of the housing. The attaching of the bullet-proof fabric to the inside top of the housing can be accomplished by looping the top 1 inch of the bullet-proof fabric onto itself and sewing it (similar to making the hem of a dress). A metal rod with a width of 18 inches can then be inserted into the loop. One end of the metal rod is attached to one sidewall of the housing in the middle about ½ inch from the top, and the other end of the metal rod attached at the exact opposite side at the same location. The bullet-proof fabric is then folded in an accordion manner such it fits inside of the housing. The housing door panel is then closed and the latch pin secured underneath the housing door panel such that the bullet-proof fabric remains inside of the housing until the lever is pulled and the housing door panel swings open, at which time the bullet-proof fabric unfurls. The lower 1 inch of the bullet-proof fabric can be looped onto itself and sewn (similar to making the hem of a dress) and several ounces of a metal beads can be added, and then the open ends of the loop sewn. The addition of the metal beads provides a weight to the lower part of the bullet-proof fabric to aid in its ability to unfurl.

What is claimed is:

1. An apparatus which can give the user of the apparatus full-body protection from a bullet fired at the user from a gun, comprising an upper part capable of being held in front of the user's head and face, the upper part having a first area consisting of a transparent bullet-proof viewing area, and a second area consisting of a second bullet-proof material abutting one or more of the top, left, right or bottom sides of the transparent bullet-proof viewing area, such width and height of the upper part consists of a combination of the first and second areas, which width and height is sufficient protect the head and shoulders of the user when the upper part is held in front of the user, and a lower part, having a third bullet proof material attached to the bottom of the upper part of the apparatus, the third bullet proof material capable of being compacted and stored immediately below the upper part, the third bullet proof material also being capable of becoming uncompacted such that in the uncompacted state, the third bullet proof material capable of being stored in its compacted state in a housing which said housing is attached to the lower side of the upper part of the present invention, the third bullet proof material has a sufficient width and height to protect the user from a bullet fired at the user from said gun, whereby the user of the apparatus is provided with full body protection from a bullet fired at the user from said gun.

2. The apparatus of claim 1 where the transparent bullet-proof viewing area is made of a bullet-proof polycarbonate material.

3. The apparatus of claim 2 where the bullet-proof fabrics are combined with a resin material such that the bullet-proof fabrics become hardened.

4. The apparatus of claim 3 where the third bullet proof material is made of a bullet proof fabric which fabric is made of a combination of one or more of Goldflex, Kevlar.

5. The apparatus of claim 1 where the second bullet proof area is made of a bullet proof fabric comprised of one or more of the bullet-proof fabrics Kevlar, Goldflex.

6. The apparatus of claim 5 where the resin material contains one or more of polyester, vinylester, or epoxy.

7. The apparatus of claim 5 where the third bullet proof material is made of a bullet proof fabric which fabric is made of a combination of one or more of Goldflex, Kevlar.

8. The apparatus of claim 1 where the third bullet proof material is a bullet proof fabric which fabric is comprised of a combination of one or more of Goldflex, Kevlar.

9. The apparatus of claim 1 where the second bullet proof material is made of a bullet proof fabric which fabric is made of a combination of one or more of Goldflex, Kevlar.

10. The apparatus of claim 1 having a handle attached to one or more of either the lower or upper parts of the apparatus whereby the user is able to hold said apparatus by said handle.

11. The apparatus of claim 10 where the third bullet proof material becomes uncompacted by the user of said apparatus actuating a mechanism on said handle which causes a door to open on said housing allowing said third bullet proof material to become uncompacted.

12. The apparatus of claim 11 where said mechanism is comprised of one or more of a button, trigger, switch or lever.

* * * * *